US012044457B2

(12) United States Patent
Olivera

(10) Patent No.: US 12,044,457 B2
(45) Date of Patent: Jul. 23, 2024

(54) NO-FROST HEAT PUMP

(71) Applicant: Addison HVAC LLC, Orlando, FL (US)

(72) Inventor: Gus Daniel Olivera, Winter Garden, FL (US)

(73) Assignee: Addison HVAC LLC, Orlando, FL (US)

( * ) Notice: Subject to any disclaimer, the term of this patent is extended or adjusted under 35 U.S.C. 154(b) by 92 days.

(21) Appl. No.: 17/684,478

(22) Filed: Mar. 2, 2022

(65) Prior Publication Data

US 2022/0282900 A1 Sep. 8, 2022

Related U.S. Application Data

(60) Provisional application No. 63/156,144, filed on Mar. 3, 2021.

(51) Int. Cl.
*F25D 21/00* (2006.01)
*F25B 30/02* (2006.01)

(52) U.S. Cl.
CPC ..... *F25D 21/002* (2013.01); *F25B 30/02* (2013.01)

(58) Field of Classification Search
CPC ..... F25D 21/002; F25D 30/02; F25D 49/02; F25D 41/20; F25D 47/022; F25D 13/00
See application file for complete search history.

(56) References Cited

U.S. PATENT DOCUMENTS

| | | | | |
|---|---|---|---|---|
| 3,332,251 | A | 7/1967 | Watkins | |
| 5,065,584 | A | 11/1991 | Byczynski et al. | |
| 2009/0277207 | A1* | 11/2009 | Park | F25B 13/00 62/324.6 |

FOREIGN PATENT DOCUMENTS

| | | | | |
|---|---|---|---|---|
| JP | S6433481 | A | * | 2/1989 |
| JP | h09257345 | A | * | 10/1997 |
| KR | 10-0681464 | B1 | | 2/2007 |
| KR | 10-2017-0025540 | A | | 3/2017 |

OTHER PUBLICATIONS

International Search Report and Written Opinion mailed Jun. 16, 2022 in International Application No. PCT/US2022/018595; 9 pages.

* cited by examiner

*Primary Examiner* — Kun Kai Ma
(74) *Attorney, Agent, or Firm* — Vedder Price P.C.

(57) ABSTRACT

An improved heat pump apparatus configured to transfer heat by circulating a refrigerant through a cycle of evaporation and condensation without the need to run a defrost cycle—the No-Frost Heat Pump (NFHP)—is provided. The NFHP is configured with a four-way valve, a suction accumulator, and a compressor to pump and exchange a refrigerant between two heat exchange coil/coils—an outdoor heat exchange coil/coil (also known as the source coil) and an indoor heat exchange coil/coil (also known as the load coil)—in order to exchange heat between the indoor/outdoor heat exchange coils. The NFHP is further configured with a means for controlling hot gas discharge—the means comprising a discharge valve or a discharge gas injection valve configured to inject refrigerant into the outdoor heat exchange coil inlet/source coil, thereby preventing the formation of ice/frost on the surface of the coil while operating in heating mode at low outdoor ambient temperatures.

23 Claims, 2 Drawing Sheets

NO-FROST HEAT PUMP

CROSS-REFERENCE TO OTHER APPLICATION

This Application claims the benefit of and priority to U.S. Provisional Application No. 63/156,144 filed Mar. 3, 2021, the content of which is hereby incorporated by reference.

FIELD OF THE DISCLOSURE

The present disclosure generally relates to an improved apparatus and method of operating a heat pump by reducing or eliminating the need for defrost cycling of the heat pump. More particularly, the present disclosure is directed to an improvement to the operational reliability and overall system capacity and efficiency of a heat pump by using novel means for injecting hot gas discharge from a compressor into the heat-exchange source coil of the heat pump and eliminating the need for defrost cycling of the heat pump.

BACKGROUND

Conventional heat pumps are widely used in the industry as part of heating and cooling systems for various facilities. A typical heat pump is an electrical device that extracts heat from one place and transfers it to another in order to maintain a constant temperature—primarily by using a refrigerant. A heat pump can be used for both heating and cooling of the facility.

A heat pump transfers heat by circulating the refrigerant through a cycle of evaporation and condensation. In a typical heat pump, a compressor pumps the refrigerant through two heat exchange coils—an outdoor heat exchange/coil (source coil) and an indoor heat exchange/coil (load coil)—in order to exchange and transfer heat between the indoor/outdoor heat exchange coils. The process entails evaporating the refrigerant at low pressure in one of the coils and absorbing heat from its surroundings and compressing the refrigerant as it travels to the other coil and then condensing it at a high pressure. Typically, conventional heat pumps are designed with a four-way reversing valve functioning as a switch between the two primary modes of operation—a cooling mode and a heating mode, as illustrated in FIG. 1.

In a conventional heat pump system, an evaporator is generally disposed along an evaporator line, a compressor system disposed along a compressor line, a condenser disposed along a condenser line and configured to condense the refrigerant compressed by the compressor system to heat a second fluid stream, and an outdoor coil disposed along a coil line and configured to receive the refrigerant from the condenser or from a discharge line, to selectively transfer heat to or from the refrigerant, and to selectively transfer the refrigerant to the evaporator or to a suction line. The refrigeration system includes two valves and three expansion valves disposed along the different refrigerant flow lines, and a controller configured to determine a simultaneous heating/cooling operating mode of the refrigeration system.

In addition, as the refrigerant captures more heat and generates higher (warmer) temperatures than the interior/load ambient air during a vapor compression cycle, heat is transferred from the refrigerant into the indoor air of the heat pump. Once the outdoor temperature decreases (generally below 40° F. in a typical heat pump operational environment), moisture in the air forms ice (frost) on the surface of the outdoor heat exchange coil thereby negating any substantial heat transfer within the heat pump and drastically reducing the heat pump performance and efficiency.

In order to counter such degradation of performance and efficiency, conventional heat pumps are designed and configured to run a defrost cycle to eliminate any frost formation. In the defrost mode, the reversing valve of the heat pump activates and runs the refrigerant backwards. A defrost cycle is generally nothing more than the system recognizing ice has formed or is beginning to form and automatically fixing it. However, the process of automatically running the defrost cycle by reversing the heat pump flow of the refrigerant further aggravates performance inefficiencies within a heat pump. For example, during a defrost cycle, first the superheated compressor discharge gas is sent to the outdoor heat exchange/coil (source coil) via a four-way reversing valve. Next, the subcooled refrigerant is sent back from the outdoor heat exchange/coil (source coil) to the indoor heat exchange/coil (load coil) after passing through an expansion or metering device and becoming colder than the indoor ambient temperature and absorbing heat from the air into the refrigerant. An auxiliary or emergency heater (usually electrical resistance or combustion heater) is then energized to compensate for the heat absorbed from the air during the defrost cycle by the indoor heat exchange/coil (load coil).

The decreased heat exchange during the frost buildup, coupled with the use of auxiliary or emergency heaters during the defrost cycle, causes large load temperature swings, loss of operation reliability and lower overall system capacity and efficiency of the heat pump. It is well known within the industry that at a minimum, using auxiliary heat in conventional heat pumps during defrost cycle operations reduces the heat pump's overall performance and/or efficiency from between 10 percent to 20 percent. Therefore, there is a dearth of systems and mechanisms that can remove some of the foregoing disadvantages caused by automatically running the defrost cycle and preventing performance reliabilities while creating inefficiencies within a heat pump. In other words, there is clearly a need within the industry for an improved apparatus and method of operating a heat pump by reducing or eliminating the need for defrost cycling of the heat pump.

The present disclosure is directed to an improvement to the operation, reliability, and overall system capacity and efficiency of a heat pump by using innovative means for injecting hot gas discharge from a compressor into the source coil distributor inlet and eliminating frost buildup on the heat pump.

BRIEF SUMMARY OF THE INVENTION

The present disclosure is directed to an improved system, method and apparatus of heating a space (or a certain volume of air) by reducing or eliminating the need for an automatic defrost cycling of a heat pump.

A no-frost heat pump (heat pump) includes an expansion valve for expanding a liquid refrigerant, a compressor for compressing the refrigerant vapor, a suction accumulator, a first heat exchange coil (functioning as the outside or outside source coil), a second heat exchange coil (functioning as the inside or indoor load coil) and a discharge valve (also known as a discharge gas injection valve)—the various components arranged in a closed loop system for heating a space or a certain volume of air. During operation, the heat pump circulates the refrigerant by pressurizing a liquid refrigerant, heating the liquid refrigerant to form a refrigerant vapor, compressing refrigerant vapor by the compressor, and supplying the heat exchange coils with refrigerant from the compressor—the refrigerant transferring heat by circulating through a cycle of evaporation and condensation, thereby enabling the exchange and transfer of heat between the indoor and outdoor heat exchange coils. During such operation in low outdoor ambient temperatures, the discharge valve—disposed upstream of the first heat exchange coil and fluidly coupled to the first heat exchange coil (source coil) is triggered to inject refrigerant directly into the outdoor heat exchange coil inlet/source coil for preventing the formation of ice/frost on the surface of the coil. Various mechanical (e.g., valves) and/or electrical means (including embedded processors running proprietary algorithms) can be used for controlling the hot gas discharge from the discharge valve of the heat pump. The heat pump disclosed herein improves operational efficiency and performance by eliminating the need for automatic defrost cycling.

In another aspect of the present disclosure, a method of operating the heat pump comprises the steps of: (1) configuring a heat pump with an expansion valve for expanding a liquid refrigerant, a compressor for compressing the refrigerant vapor, a suction accumulator, a first heat exchange coil (functioning as the outside source coil), a second heat exchange coil (functioning as the inside load coil) and a discharge gas injection valve—the various components arranged in a closed loop system for heating a space; (2) circulating the refrigerant through the closed loop system by pressurizing the liquid refrigerant, heating the liquid refrigerant to form a refrigerant vapor, compressing refrigerant vapor by the compressor, and supplying the heat exchange coils with refrigerant from the compressor; (3) exchanging heat between the indoor/outdoor heat exchange coils by circulating the refrigerant through a cycle of evaporation and condensation; and wherein (4) during operation of the heat pump in low outdoor ambient temperatures, the discharge gas injection valve disposed upstream of the first heat exchange coil and fluidly coupled to the first heat exchange coil (source coil) is triggered to inject refrigerant directly into the outdoor heat exchange coil inlet/source coil for preventing the formation of ice/frost on the surface of the coil.

In another aspect of the present disclosure, the heat pump cycle using an expansion valve for expanding the refrigerant fluid and a compressor for the compression of the refrigerant vapor can be used for a wide variety of applications—including using the heat pump cycle for both cooling and heating of a space. For instance, in the cooling mode, such systems pass saturated liquid refrigerant through an expansion valve to lower the refrigerant's pressure, and therefore the saturation temperature of the refrigerant correspondingly falls, and the cooled refrigerant is then directed to an evaporator where heat is absorbed from the atmosphere, thereby cooling the environmental space (or some other medium where cooling is desired). This cycle may be reversed, thus permitting the same system to operate as a heat pump.

BRIEF DESCRIPTION OF THE DRAWINGS

Certain embodiments are shown in the drawings. However, it is understood that the present disclosure is not limited to the arrangements and instrumentality shown in the attached drawings.

DETAILED DESCRIPTION OF THE DISCLOSURE

Figure 1:
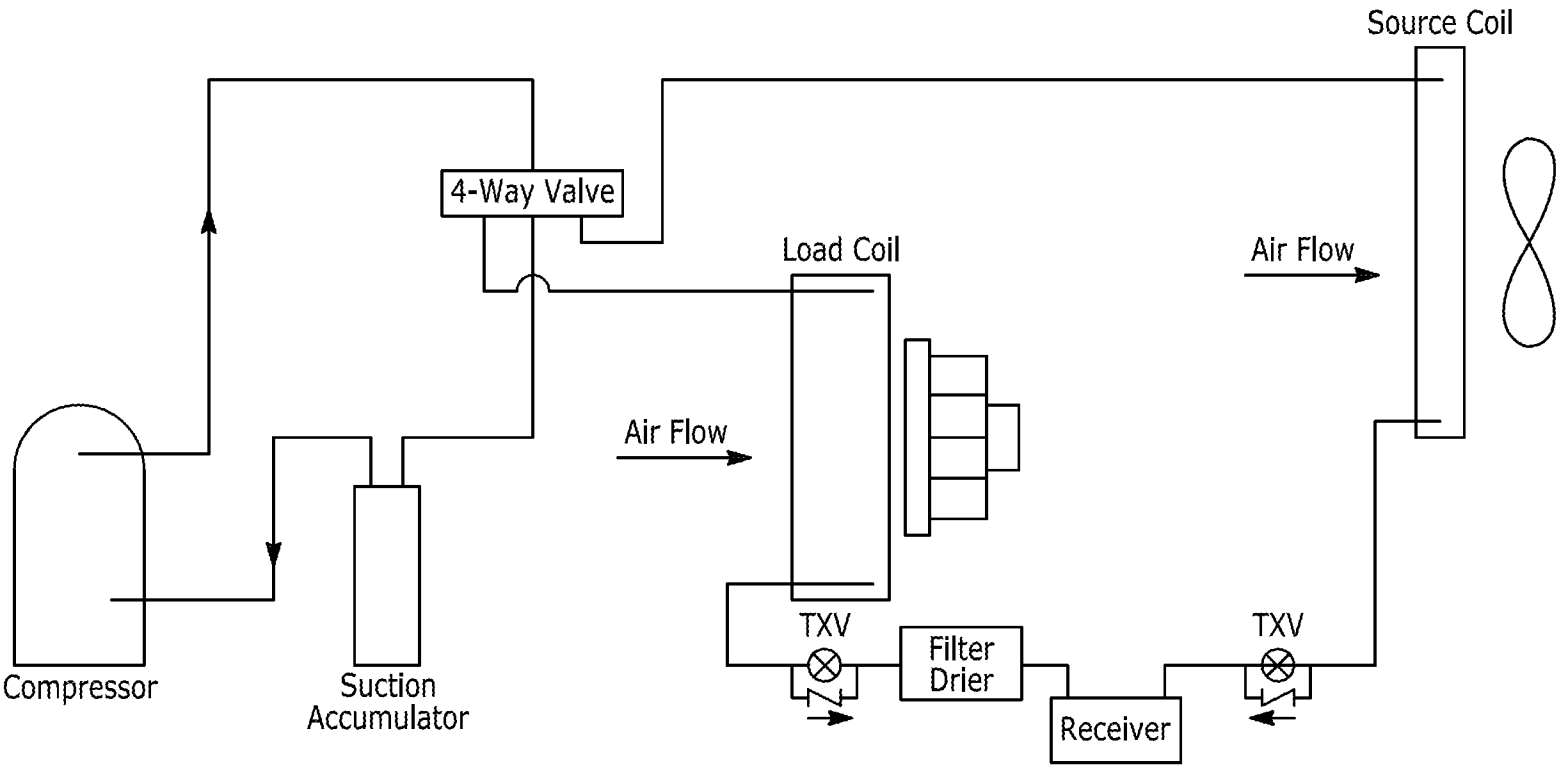
(Prior Art) FIGURE 1
FIG. 1 shows a conventional heat pump used for transferring heat by circulating a refrigerant through a cycle of evaporation and condensation.

For the purposes of promoting and understanding the principles disclosed herein, reference is now made to the preferred embodiments illustrated in the drawings, and specific language is used to describe the same. Embodiments disclosed in the present disclosure provide a novel and improved method and apparatus of operating a heat pump by reducing or eliminating the need for automatically running a defrost cycle within a heat pump.

Figure 2:
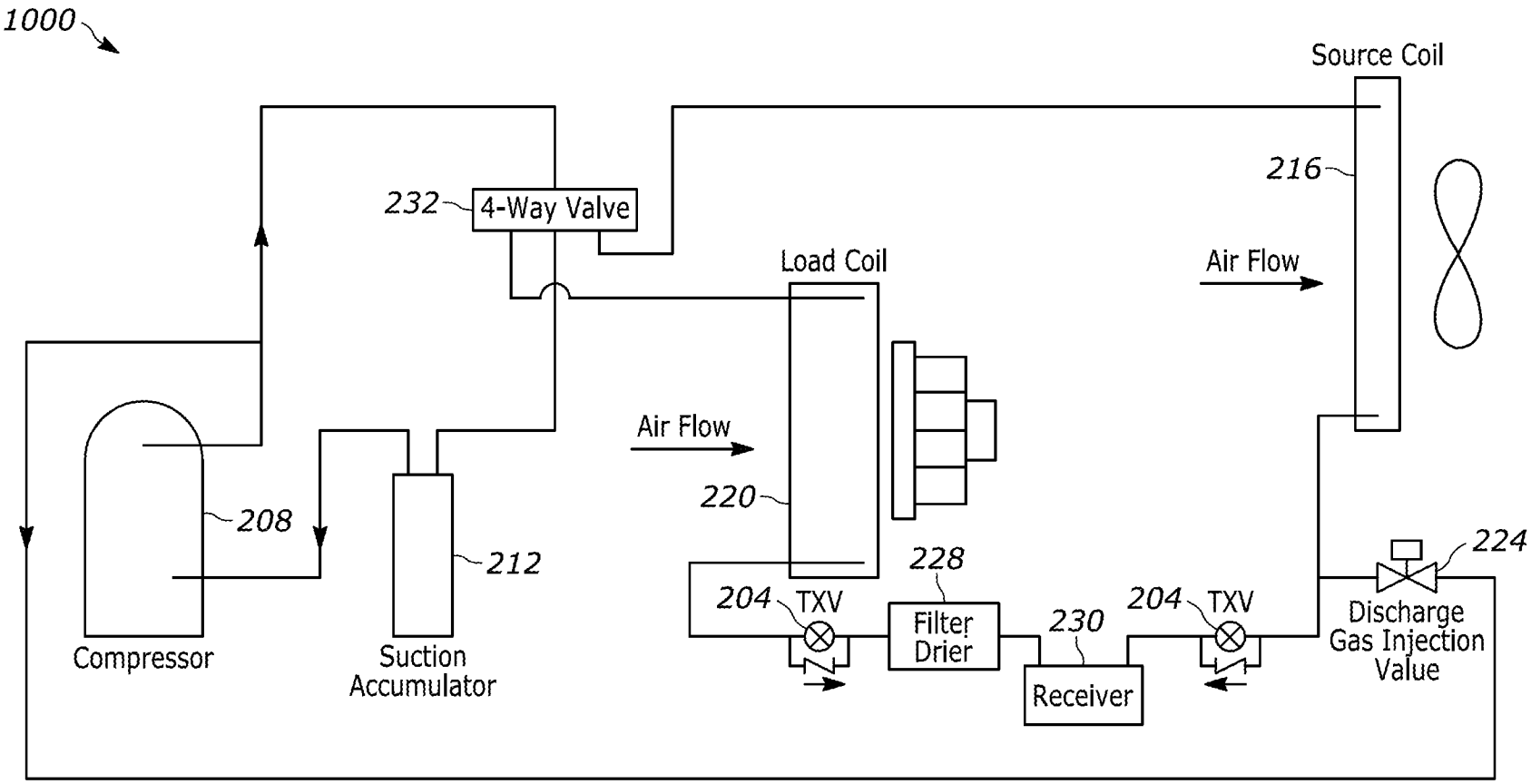
FIG. 2 shows a no-frost heat pump apparatus configured with control means of injecting hot gas discharge into the outdoor heat exchange coil inlet/source coil to eliminate any frost buildup on the heat pump.

In FIG. 2, a no-frost heat pump 1000 (heat pump 1000) is shown as configured to transfer heat by circulating a refrigerant through a cycle of evaporation and condensation without the need to run a defrost cycle. As illustrated in FIG. 2, the heat pump 1000 includes an expansion valve 204 for expanding a liquid refrigerant, a compressor 208 for compressing the refrigerant vapor, a suction accumulator 212, a first heat exchange coil 216 (functioning as the outside source coil or the outdoor coil), a second heat exchange coil 220 (functioning as the inside load coil or the indoor coil) and a discharge valve 224—the various components arranged in a closed loop system for heating a space.

The first heat exchange coil 216 functions as the source coil and the second heat exchange coil 220 functions as the load coil for the heat pump 1000 disclosed herein. During operation, the heat pump 1000 circulates the refrigerant by pressurizing a liquid refrigerant, heating the liquid refrigerant to form a refrigerant vapor, compressing refrigerant vapor by the compressor 208, and supplying the heat exchange coil with refrigerant from the compressor—the refrigerant transferring heat by circulating through a cycle of evaporation and condensation, thereby enabling the exchange and transfer of heat between the indoor and outdoor heat exchange coils (216, 220). The source and the load coils (216, 220) work in conjunction to exchange the heat between the indoor and the outdoor heat exchange coils.

As further illustrated in FIG. 2, the heat pump 1000 is configured with a means for controlling discharge of hot gas via the usage of the discharge valve 224 (also can be referred to as a discharge gas injection valve 224) disposed upstream of the first heat exchange coil and fluidly coupled to the first heat exchange coil the source/outdoor coil 216 and within the closed loop system of the heat pump. During operation in low outdoor ambient temperatures, the discharge valve 224 located in proximity to the source/outdoor coil 216 is triggered to inject refrigerant directly into the source/outdoor coil 216 for preventing any formation of ice/frost on the surface of the coil. As can be contemplated by one of ordinary skill in the art, various other kind of valves and/or electrical mechanism (including embedded processors running proprietary algorithms) can be used for controlling the discharge of the hot gas from the discharge valve in the heat pump disclosed herein.

The heat pump disclosed herein provides substantial performance improvements to the pump's operating range, reliability and longevity. It is to be noted that by eliminating the need for an automatic defrost cycle and the use of auxiliary or emergency heaters during the defrost cycle, the heat pump further prevents large load temperature swings and improves overall system capacity and efficiency of the heat pump. The heat pump can be used for air-to-water heat pump equipment for processing potable hot water generation within the equipment or as a Dedicated Outdoor Air System (DOAS) to artificially load the evaporator coil (load coil) and maintain proper operating suction pressure and temperature while the DOAS is operating at light load conditions.

Apparatus, system and methods disclosed herein can be used for various other equipment including, but not limited to, Process Chillers, Recirculating Heating and Cooling Equipment, HVACs, Hybrid Heat Pumps, Electric Heat Pumps and other similar heating, cooling and ventilation systems.

The use of the terms "a," "an" and "the" and similar referents in the context of describing the invention (especially in the context of the following claims) is to be construed to cover both the singular and the plural, unless otherwise indicated herein or clearly contradicted by context. The terms "comprising," "having," "including" and "containing" are to be construed as open-ended terms (i.e., meaning "including, but not limited to,") unless otherwise noted. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

It is understood that the preceding is merely a detailed description of some examples and embodiments of the present disclosure, and that numerous changes to the disclosed embodiments may be made in accordance with the disclosure made herein without departing from the spirit or scope of the disclosure. The preceding description, therefore, is not meant to limit the scope of the disclosure, but to provide sufficient disclosure to allow one of ordinary skill in the art to practice the disclosure without undue burden. The scope of the present disclosure fully encompasses other embodiments that may become obvious to those skilled in the art. Features illustrated or described as part of one embodiment can be used in another embodiment to yield a still further embodiment. Thus, it is intended that the present disclosure cover such modifications and variations as come within the scope of the appended claims and their equivalents. It is to be understood by one of ordinary skill in the art that the present discussion is a description of exemplary embodiments only, and is not intended as limiting the broader aspects of the present disclosure, which broader aspects are embodied in the exemplary constructions.

The invention claimed is:

1. A heat pump apparatus comprising:

a compressor;

a first heat exchange coil and a second heat exchange coil, the first and the second heat exchange coils located downstream of the compressor, wherein each of the first and second heat exchange coils are fluidly coupled to the compressor;

an expansion valve disposed upstream of the compressor and fluidly coupled to the compressor in order to regulate a supply of refrigerant to the compressor;

a discharge valve fluidly disposed upstream of the first heat exchange coil and fluidly coupled to the first heat exchange coil;

the compressor, the first heat exchange coil, the second heat exchange coil, the expansion valve, and the discharge valve connected in a series to form a closed loop system for heating or cooling a space;

wherein the compressor is configured to circulate the refrigerant through a cycle of evaporation and condensation between the first heat exchange coil and the second heat exchange coil such that heat is exchanged between the first and second heat exchange coils;

wherein the discharge valve is disposed to inject refrigerant directly into an inlet end of the first heat exchange coil and prevent the formation of ice on a surface of the first heat exchange coil during operation of the heat pump at a certain ambient temperature; and wherein the heat pump is configured as air-to-water heat pump system to generate potable hot water.

2. The heat pump apparatus of claim 1, wherein the first heat exchange coil is an outdoor heat exchange coil source coil.

3. The heat pump apparatus of claim 1, wherein the second heat exchange coil is an indoor heat exchange coil load coil.

4. The heat pump apparatus of claim 1, wherein the ambient temperature is the temperature of the air surrounding the first heat exchange coil.

5. The heat pump apparatus of claim 4, wherein the ambient temperature is below 40° F.

6. The heat pump apparatus of claim 1, further comprising a four-way reversing valve fluidly coupled to the compressor and configured to switch between a heating mode and a cooling mode by reversing the refrigeration cycle.

7. The heat pump apparatus of claim 1, wherein the discharge valve is a gas injection valve.

8. The heat pump apparatus of claim 1, wherein a control system having an embedded processor is configured to run a proprietary algorithm and automatically activate the discharge valve to inject refrigerant directly into the inlet end of the first heat exchange coil during operation of the heat pump at a certain ambient temperature.

9. The heat pump apparatus of claim 1, wherein the refrigerant injected to the inlet end of the first heat exchange coil is a hot gas refrigerant generated from the compressor during operation of the heat pump.

10. The heat pump apparatus of claim 1, wherein the discharge valve prevents the formation of ice on the surface of the coil while the heat pump is operating in a heating mode.

11. The heat pump apparatus of claim 1, wherein the discharge valve improves operational efficiency of the heat pump by preventing large load temperature swings during operation of the heat pump.

12. A method of heating or cooling a space, the method comprising the steps of:

configuring a first heat exchange coil and a second heat exchange coil to be in a closed loop fluid communication with a compressor, wherein the first and the second heat exchange coils are located downstream of the compressor;

configuring an expansion valve to be in a closed loop fluid communication with the compressor; wherein the expansion valve is disposed upstream of the compressor;

regulating a supply of refrigerant to the compressor via the expansion valve;

configuring a discharge valve to be in a closed loop fluid communication with the first heat exchange coil and the expansion valve; wherein the discharge valve is fluidly disposed upstream of the first heat exchange coil;

circulating the refrigerant through a cycle of evaporation and condensation through the first heat exchange coil and the second heat exchange coil;

exchanging heat between the first heat exchange coil and the second heat exchange coil;

injecting refrigerant from the discharge valve directly into an inlet end of the first heat exchange coil and preventing the formation of ice on the surface of the first heat exchange coil during operation of the heat pump at a certain ambient temperature; and configuring the heat pump as an air-to-water heat pump system for generating potable hot water.

13. The method of claim 12, wherein circulating the refrigerant further comprises the steps of:

pressurizing a liquid refrigerant;

heating the liquid refrigerant to form a refrigerant vapor;

compressing the refrigerant; and supplying the first heat exchange coil with refrigerant from the compressor.

14. The method of claim 12, wherein the first heat exchange coil is an outdoor heat exchange source coil.

15. The method of claim 12, wherein the second heat exchange coil is an indoor heat exchange load coil.

16. The method of claim 12, wherein the ambient temperature is the temperature of the air surrounding the first heat exchange coil.

17. The method of claim 12, wherein the certain ambient temperature is below 40° F.

18. The method of claim 12, further comprising the steps of configuring a four-way reversing valve in closed loop fluid communication with the compressor to alternate between a heating mode and a cooling mode by reversing the refrigeration cycle.

19. The method of claim 12, wherein the discharge valve is a gas injection valve.

20. The method of claim 12, wherein a control system having an embedded processor is configured to run a proprietary algorithm and automatically activate the discharge valve to inject refrigerant directly into the inlet end of the first heat exchange coil during operation of the heat pump at a certain ambient temperature.

21. The method of claim 12, wherein the refrigerant injected to the inlet end of the first heat exchange coil is a hot gas refrigerant generated from the compressor.

22. The method of claim 12, wherein the discharge valve prevents the formation of ice on the surface of the coil while the heat pump is operating in a heating mode.

23. The method of claim 12, wherein the discharge valve improves operational efficiency by preventing large load temperature swings during operation of the heat pump.

* * * * *